US012631175B2

(12) United States Patent
Kuismanen et al.

(10) Patent No.: US 12,631,175 B2
(45) Date of Patent: May 19, 2026

(54) METHOD FOR HEAT RECOVERY IN A COMPRESSOR AND A COMPRESSOR

(71) Applicant: TAMTURBO OYJ, Tampere (FI)

(72) Inventors: Olli Kuismanen, Tampere (FI); Juha Lammi, Pirkkala (FI)

(73) Assignee: TAMTURBO OYJ, Tampere (FI)

( * ) Notice: Subject to any disclaimer, the term of this patent is extended or adjusted under 35 U.S.C. 154(b) by 10 days.

(21) Appl. No.: 18/575,594

(22) PCT Filed: Jun. 28, 2022

(86) PCT No.: PCT/FI2022/050476
§ 371 (c)(1),
(2) Date: Dec. 29, 2023

(87) PCT Pub. No.: WO2023/275441
PCT Pub. Date: Jan. 5, 2023

(65) Prior Publication Data

US 2024/0295214 A1 Sep. 5, 2024

(30) Foreign Application Priority Data

Jun. 29, 2021 (FI) ..... 20215768

(51) Int. Cl.
*F04B 53/08* (2006.01)
*F04B 25/00* (2006.01)
(Continued)

(52) U.S. Cl.
CPC ..... *F04B 53/08* (2013.01); *F04B 25/00* (2013.01); *F04B 39/06* (2013.01); *F28D 21/0003* (2013.01)

(58) Field of Classification Search
CPC ..... F04B 53/08; F04B 25/00; F04B 39/06; F28D 21/0003
See application file for complete search history.

(56) References Cited

U.S. PATENT DOCUMENTS 5,385,449 A * 1/1995 Wenzel ..... F04D 25/16 417/364
2005/0098307 A1* 5/2005 Goto ..... F28D 7/1653 165/146

(Continued)

FOREIGN PATENT DOCUMENTS

JP 2016079894 A 5/2016
WO 2011088527 A2 7/2011
WO 2020195528 A1 10/2020

OTHER PUBLICATIONS

European Search Report for Application EP 22832259.0 dated Feb. 20, 2025, (8 pages).

(Continued)

*Primary Examiner* — Bryan M Lettman
(74) *Attorney, Agent, or Firm* — Meunier Carlin & Curfman LLC

(57) ABSTRACT

The compressor comprises a plurality of compression stages for compressing gas and two or more compressed gas heat exchangers for cooling compressed gas. Each heat exchanger comprises a primary part for transferring the compressed gas through the heat exchanger and secondary parts for transferring coolant through the heat exchanger for recovering heat from the compressed gas. The compressor further comprises liquid to liquid heat exchangers for cooling of internal components of the compressor. A coolant circuitry conducts the coolant via the liquid to liquid heat exchanger and the compressed gas heat exchangers; and a gas flow circuitry conducts gas via the compression stages and the compressed gas heat exchangers. The coolant circuitry is at least partly coupled in series so that the liquid to liquid heat exchanger is the first or the second in the series connection and at least two compressed gas heat exchangers are in series connection.

15 Claims, 11 Drawing Sheets

(51) Int. Cl.
*F04B 39/06* (2006.01)
*F28D 21/00* (2006.01)

(56) References Cited

U.S. PATENT DOCUMENTS

| | | | | |
|---|---|---|---|---|
| 2012/0137698 | A1* | 6/2012 | Sjodin | F01K 23/10 60/774 |
| 2013/0125568 | A1 | 5/2013 | Chalk et al. | |
| 2014/0262165 | A1* | 9/2014 | Ishimori | F28F 1/06 165/109.1 |
| 2016/0102632 | A1* | 4/2016 | Han | F28D 7/0066 60/616 |
| 2018/0154302 | A1* | 6/2018 | Vertriest | F04B 39/16 |
| 2018/0363976 | A1* | 12/2018 | Nagao | F25J 1/0032 |
| 2022/0163027 | A1* | 5/2022 | Matsuzaka | F04C 28/26 |

OTHER PUBLICATIONS

International Search Report and Written Opinion in Application No. PCT/FI2022/050476, mailed Sep. 20, 2022, 13 pages.
International Preliminary Report on Patentability in Application No. PCT/FI2022/050476, dated Jun. 1, 2023, 47 pages.

* cited by examiner

METHOD FOR HEAT RECOVERY IN A COMPRESSOR AND A COMPRESSOR

This is a U.S. national stage application of the international application number PCT/FI2022/050476 filed on Jun. 28, 2022 claiming priority to the Finnish national application Ser. No. 20/215,768 filed on Jun. 29, 2021.

TECHNICAL FIELD

The present invention relates to a method for heat recovery in a compressor. The method also relates to a compressor comprising a plurality of compression stages for compressing gas; three or more heat exchangers for cooling compressed gas, each of the three or more heat exchangers comprising at least a primary part having a gas input for entering the compressed gas for cooling and a gas output for outputting the cooled gas from the primary part, and a secondary part having a coolant input for entering the coolant and a coolant output for outputting the coolant from the secondary part; the compressor further comprising a coolant circuitry for conducting flow of the coolant via the three or more heat exchangers; and a gas flow circuitry for conducting flow of gas in series via the plurality of compression stages and the heat exchangers.

BACKGROUND

Compressors typically have one or more heat exchangers for reducing temperature of gas compressed by one or more compressor stages of the compressor. Multi-stage compressors typically have heat exchangers after each compression stage to cool down gas compressed by the compression stage. Coolant inlets of the heat exchangers are usually coupled in parallel so that the coolant, such as water, is fed in parallel to each heat exchanger. This means that the temperature of the coolant is the same at each input of the heat exchangers. However, each compressor stage may not have the same operation parameters wherein the heat recovery efficiency and consequently the efficiency of each compressor stage may not be optimum.

It is known that the temperature at an inlet of a compressor stage affects the efficiency of the compressor stage. Basically, the higher the temperature of the gas at the inlet the higher is the energy needed for the compression.

Heat exchangers typically have a primary part and a secondary part. Some heat exchangers may also have a tertiary part. In compressor applications one of the parts, such as the primary part, is provided for leading compressed gas through the heat exchanger and the secondary part is provided for leading the coolant through the heat exchanger. Hence, at least a part of the heat of the compressed gas is transferred from the compressed gas to the coolant when the temperature of the compressed gas is higher than the temperature of the coolant.

Transferring heat from one substance to another substance can also be called heat recovery from one substance to another substance.

SUMMARY

According to some embodiments of the present invention there is provided a method and a multi-stage compressor in which heat recovery efficiency and the outlet coolant temperature can be improved compared to prior art methods and compressors. One basic idea behind the invention is to arrange a coolant circuitry so that the order in which the coolant flows through different heat exchangers can be selected based on the compression parameters, either statically or dynamically, and the order of heat recovery is different from the order in which the compressed gas flows through different heat exchangers.

In a series connection of the cooling circuitry the coolant or a part of the coolant from an output of one heat exchanger is conducted to an input of another heat exchanger.

In this specification the expression "the order of the compression stages" means the order in which gas to be compressed travels through the compression stages of the compressor: a first compression stage is the compression stage to which the gas is input from outside the compressor and the last compressor stage outputs the compressed gas for further processing e.g. for utilizing in a manufacturing plant, or after treatment, filtration, drying etc. However, it may also be possible to have intermediate gas outlet(s) in a compressor from which a part of the gas can be taken out from the compressor.

According to a first aspect of the present disclosure there is provided a compressor comprising:

- a plurality of compression stages connected in series for compressing gas;
- three or more heat exchangers for cooling compressed gas, each of the three or more heat exchangers comprising at least:
  - a primary part for transferring the compressed gas through the heat exchanger; and
  - one or more secondary parts for transferring coolant through the heat exchanger for recovering heat from the compressed gas;
- a coolant circuitry for conducting flow of the coolant via the three or more heat exchangers;
- a gas flow circuitry for conducting flow of gas via the plurality of compression stages and the heat exchangers;

characterized in that the compressor further comprises:

- means for bypassing at least partially any of the heat exchangers to optimize at least one of:
  - coolant temperature;
  - compression efficiency.

In accordance with an embodiment the coolant circuitry is at least partly coupled in series so that the liquid to liquid heat exchanger is the first or the second in a sequence of the series connection and at least two of the two or more compressed gas heat exchangers are in series connection, wherein the liquid to liquid heat exchanger is either in series with the compressed gas heat exchangers or in parallel with at least one of the compressed gas heat exchangers.

In accordance with an embodiment the coolant circuitry of at least three or more heat exchangers is at least partly coupled in series so that the series connection is at least partly different from the series connection between the compressor stages and different from a reversed order of the compressor stages and selected to optimize coolant temperature or energy content.

In accordance with an embodiment at least one heat exchanger is coupled with a gas output of each compression stage.

In accordance with an embodiment at least one heat exchanger is coupled with a gas output of each compression stage.

In accordance with an embodiment the amount of heat exchangers is at least one more than the amount of the compression stages.

In accordance with an embodiment the means for bypassing comprise one or more controllable valves.

According to a second aspect of the present disclosure there is provided a compressor comprising:

a plurality of compression stages connected in series for compressing gas;

two or more compressed gas heat exchangers for cooling compressed gas, each of the two or more heat exchangers comprising at least:

a primary part for transferring the compressed gas through the heat exchanger; and one or more secondary parts for transferring coolant through the heat exchanger for recovering heat from the compressed gas;

one or more liquid to liquid heat exchangers for cooling of internal components of the compressor comprising at least:

a primary part for transferring coolant through the heat exchanger; and one or more secondary parts for transferring a cooling substance through the liquid to liquid heat exchanger for transferring heat from the internal components to the cooling substance;

a coolant circuitry for conducting flow of the coolant via the liquid to liquid heat exchanger and the two or more compressed gas heat exchangers;

a gas flow circuitry for conducting flow of gas in series via the plurality of compression stages and the compressed gas heat exchangers;

characterized in that the coolant circuitry is at least partly coupled in series so that the liquid to liquid heat exchanger is the first or the second in a sequence of the series connection and at least two of the two or more compressed gas heat exchangers are in series connection.

In accordance with an embodiment there is provided a compressor with two or more compression stages so that at least three cooling stages are in series so that the order in which coolant is provided to the at least three cooling stages is selectable based on one or more predetermined criteria.

In accordance with an embodiment there is provided a compressor with two or more compression stages so that at least three cooling stages are in series so that the order in which coolant is provided to the at least three cooling stages is selectable based on one or more predetermined criteria.

In accordance with an embodiment there is provided a compressor with two or more compression stages so that at least three cooling stages are in series so that the order in which coolant is provided to the at least three cooling stages is adjustable during operation of the compressor.

In accordance with an embodiment there can also exist a tertiary cooling circuit for transferring heat from the compressor components (i.e. not from the compressed air), said cooling circuit can be parallel to or in series with any of the compressed air cooling circuits, said circuitry can be adjustable during operation of the compressor.

In accordance with an embodiment the compressor is an air compressor.

In accordance with an embodiment there is provided an air compressor with two or more compression stages so that at least two cooling stages are at least partially in series to increase the temperature of the outgoing coolant.

In accordance with an embodiment there is provided an air compressor having one or more intercoolers between compression stages and an aftercooler after a last compression stage downstream of the gas flow, wherein the intercoolers are in the series before the aftercooler. This may prevent air from being too hot in compression process. However, the aftercooler can also be located before one or more of the intercoolers.

In accordance with an embodiment there is provided an air compressor equipped with an additional aftercooler to cool the compressed air after the compressor.

In accordance with an embodiment there is provided an air compressor in which all heat exchangers are in series.

In accordance with an embodiment there is provided an air compressor in which only some but not all of the heat exchangers are in series.

In accordance with an embodiment the coolant flow and the order of the partially or completely in series cooling stages are adjustable based on operating characteristics.

In accordance with an embodiment the logic with which the coolant flows through the heat exchangers is adjusted to optimize the coolant temperature and compression efficiency.

In accordance with an embodiment there is provided an air compressor having three separate cooling circuits so that one of the cooling circuits utilizes the heat recovered by the heat exchangers and another of the cooling circuits dissipates the heat into the atmosphere.

In accordance with an embodiment there is provided an air compressor comprising an additional aftercooler which is water cooled.

In accordance with an embodiment there is provided an air compressor comprising an additional aftercooler which is air cooled.

In accordance with an embodiment there is provided an air compressor having an air dryer, which can be of the Heat of Compression type dryer, the compressor outlet temperature is selected to optimize the efficiency of the dryer and the heat utilization of the manufacturing plant.

According to a third aspect of the present disclosure there is provided a compressor comprising:

a plurality of compression stages connected in series for compressing gas;

three or more heat exchangers for cooling compressed gas, each of the three or more heat exchangers comprising at least:

a primary part for transferring the compressed gas through the heat exchanger; and one or more secondary parts for transferring coolant through the heat exchanger for recovering heat from the compressed gas;

a coolant circuitry for conducting flow of the coolant via the three or more heat exchangers;

a gas flow circuitry for conducting flow of gas via the plurality of compression stages and the heat exchangers;

wherein the coolant circuitry of at least three or more heat exchangers is at least partly coupled in series so that the series connection is at least partly different from the series connection between the compressor stages and different from a reversed order of the compressor stages and selected to optimize coolant temperature or energy content.

In accordance with an embodiment at least one heat exchanger is coupled with a gas output of each compression stage.

In accordance with an embodiment the order in which the secondary parts of the heat exchangers are coupled by the coolant circuitry is selected based on one or more predetermined criteria.

In accordance with an embodiment one or more predetermined criteria is one or more of the following:

- amount of heat needed for a process utilizing the coolant which exits from a coolant circulation;
- the maximum amount of air which is allowed in an input of the compressor;
- the temperature of the compressed gas at an output of the compressor;
- the temperature of the liquid exiting from the compressor;
- efficiency of the compressor;
- the temperature of the coolant at an input of the circulation circuitry; and/or
- pressure ratios between different compression stages.

In accordance with an embodiment at least one heat exchanger is coupled with a gas output of each compression stage.

In accordance with an embodiment the amount of heat exchangers is at least one more than the amount of the compression stages.

In accordance with an embodiment the compressor comprises means for adjusting mutual connections between the three or more heat exchangers by the coolant circuitry.

In accordance with an embodiment the means for adjusting mutual connections comprise controllable valves.

In accordance with an embodiment the means for adjusting mutual connections are configured to adjust the mutual connections between the three or more heat exchangers based on operating characteristics of the compressor or the environment the compressor is operating.

In accordance with an embodiment the means for adjusting mutual connections are configured to adjust the mutual connections or at least partially bypass any of the three heat exchangers to optimize coolant temperature and compression efficiency.

In accordance with an embodiment the compressor comprises two separate cooling circuits so that one of the cooling circuits is configured to utilize the heat recovered by the heat exchangers and another of the cooling circuits is configured to dissipate heat into the atmosphere.

In accordance with an embodiment the compressor is configured to adjust the two separate cooling circuits to optimize the efficiency of a dryer and heat utilization of a manufacturing plant.

In accordance with an embodiment the heat exchangers comprise:

- a primary part having a gas input for entering the compressed gas for cooling and a gas output for outputting the cooled gas from the primary part; and
- a secondary part having a coolant input for entering the coolant and a coolant output for outputting the coolant from the secondary part.

In accordance with an embodiment the compressor comprises an additional aftercooler, which is water cooled.

In accordance with an embodiment the coolant circuitry comprises

- a coolant input for receiving coolant to the coolant circuitry from an external coolant source; and
- a coolant output for exiting the coolant from the coolant circuitry.

The present invention may improve heat recovery efficiency of the compressor inter alia due to the possibility to arrange the series connection of different heat exchangers so that the overall efficiency of the compressor can be increased and/or waste energy can be utilized at least partly. One factor which may affect the efficiency is the temperature of the coolant entering a heat exchanger. For some compression stages it may be beneficial to have a low temperature of the input gas flow which may be achieved by inputting a coolant as cold as possible to the preceding heat exchanger whereas for some other compression stages higher temperature of the input gas flow may be acceptable in view of the overall efficiency of the compressor.

BRIEF DESCRIPTION OF THE DRAWINGS

In the following, some embodiments of the disclosure are described in more detail with reference to the appended drawings, in which.

DETAILED DESCRIPTION

Figure 1:
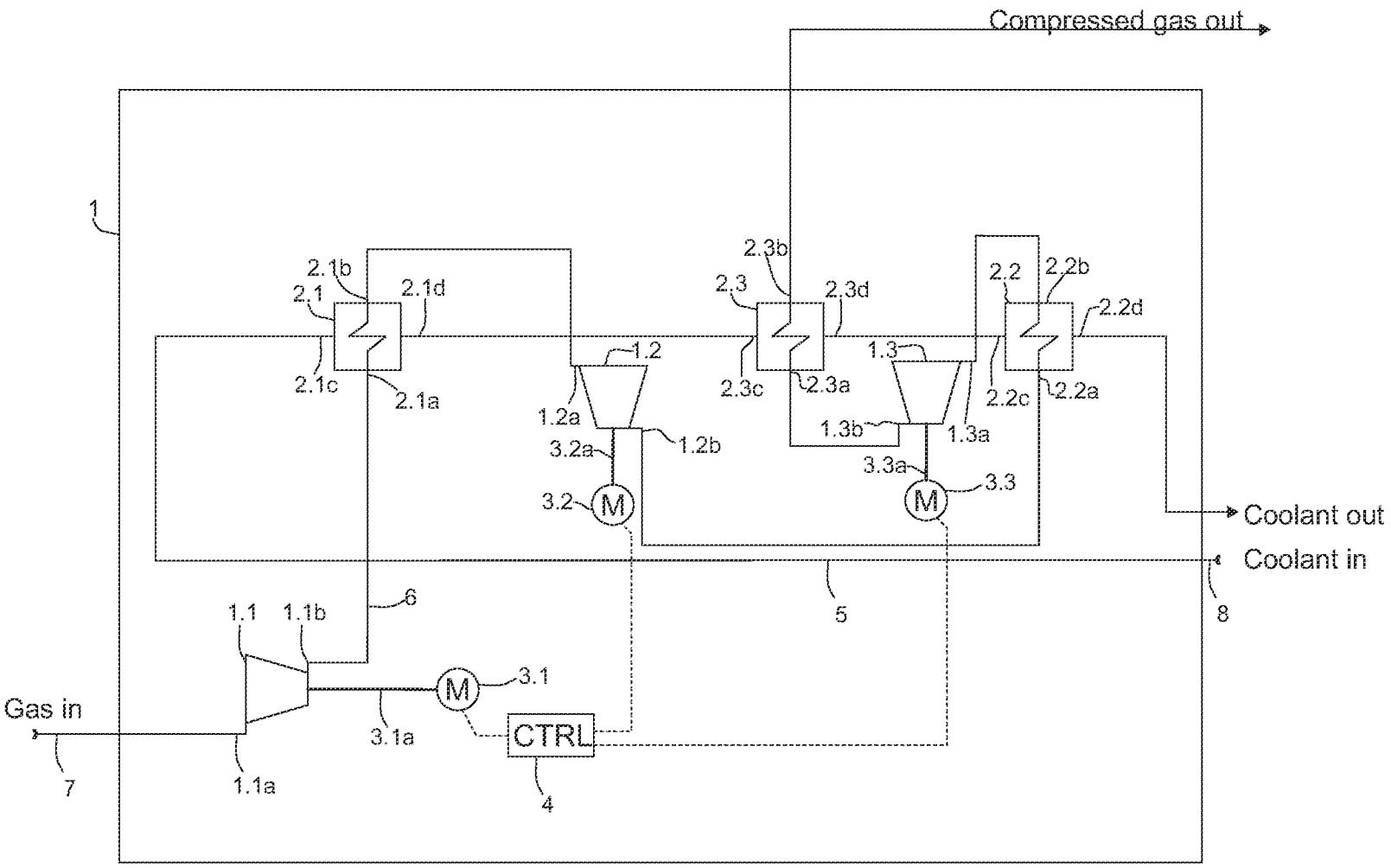
FIG. 1 illustrates as a simplified process chart a compressor, in accordance with an embodiment.

FIG. 1 illustrates as a simplified process chart an example of a multi-stage compressor 1 having several heat exchangers 2. In this example the compressor has three compression stages 1.1, 1.2, 1.3 and three compressed gas heat exchangers 2.1, 2.2, 2.3 but in practical implementations the compressor 1 could also have only two compression stages or more than three compression stages and/or more than three heat exchangers. Furthermore, the amount of the compression stages and the amount of the heat exchangers need not be the same.

In the following the compressed gas heat exchangers 1.1-1.3 may also be called as heat exchangers 1.1-1.3 whereas a heat exchanger for internal cooling 17 is called as a liquid to liquid heat exchanger 2.4.

Each compression stage 1.1, 1.2, 1.3 has a gas input 1.1*a*, 1.2*a*, 1.3*a* and a gas output 1.1*b*, 1.2*b*, 1.3*b*. Each exchanger 2.1, 2.2, 2.3 has a primary part for cooling gas and a secondary part for coolant. The primary parts have a gas input 2.1*a*, 2.2*a*, 2.3*a* and a gas output 2.1*b*, 2.2*b*, 2.3*b* and the secondary parts have a coolant input 2.1*c*. 2.2*c*, 2.3*c* and a coolant output 2.1*d*, 2.2*d*, 2.3*d*.

The compressor 1 has at least one motor 3 for rotating one or more compression stages 1.1, 1.2, 1.3. In some embodiments there is only one motor 3.1 wherein each compression stage is coupled to an axis 3.1*a* of the motor 3 but in the example of FIG. 1 all compression stages 1.1, 1.2, 1.3 are driven by an individual motor 3.1, 3.2, 3.3 so that the first compression stage 1.1 is coupled to an axis 3.1*a* of the first motor 3.1, the second compression stage 1.2 is coupled to an axis 3.2*a* of the second motor 3.2, and the third compression stage 1.3 is coupled to an axis 3.3*a* of the third motor 3.3. In yet another embodiment some compression stages may be powered by the same motor and some other compression stage or stages may be powered by another motor or motors. Each motor 3 may also have a motor control circuitry 4, or there may be a common motor control circuitry as shown in the example of FIG. 1, where each motor 3.1, 3.2, 3.3 is controlled by the same motor control circuitry 4.

The compressor 1 also has a coolant circuitry 5 for conducting flow of the coolant via the secondary parts of the heat exchangers 2 and a gas flow circuitry 6 for conducting flow of gas via the compression stages 1.1, 1.2, 1.3 and the heat exchangers 2.1, 2.2, 2.3.

It should be noted that the compressor 1 may also have further components such as valves, dryers, etc. which are not shown in FIG. 1.

In the embodiment of FIG. 1 the flow of the gas to be compressed is as follows. Gas arrives from a gas source 7 at the gas input 1.1*a* of the first compression stage 1.1. Gas is, for example, outside air or from other source of gas. The motor 3.1 rotates the axis 3.1*a* of the motor which rotates the first compression stage 1.1 for compressing the gas. The compressed gas is output from the gas output 1.1*b* of the first compression stage 1.1. The gas flow circuitry 6 carries the compressed gas from the first compression stage 1.1 to the gas input 2.1*a* of the primary part of the first heat exchanger 2.1 for lowering the temperature of the compressed gas i.e. recovering heat from the compressed gas. The gas output 2.1*b* of the primary part of the first heat exchanger 2.1 is in a flow connection to the gas input 1.2*a* of the second compression stage 1.2, wherein the cooled, compressed gas can flow to the second compression stage 1.2 for further compression. Gas compressed by the second compression stage 1.2 is output from the gas output 1.2*b* of the second compression stage 1.2. The gas flow circuitry 6 carries the compressed gas from the second compression stage 1.2 to the gas input 2.2*a* of the primary part of the second heat exchanger 2.2 for recovering heat from the compressed gas. The gas output 2.2*b* of the primary part of the second heat exchanger 2.2 is in a flow connection to the gas input 1.3*a* of the third compression stage 1.3, wherein the cooled, compressed gas can flow to the third compression stage 1.3 for further compression. Gas compressed by the third compression stage 1.3 is output from the gas output 1.3*b* of the third compression stage 1.3 and flows to the gas input 2.3*a* of the primary part of the third heat exchanger 2.3. The cooled gas can be taken from the output 2.2*d* of the primary part of the third heat exchanger 2.3 for further processing, for example for drying, for utilization in a manufacturing plant, a power plant etc. The utilization of the gas compressed by the compressor 1 is basically irrelevant for the description and understanding the present invention, wherein it will not be described in more detail here.

Next, the flow of the coolant in the compressor 1 of FIG. 1 will be described in more detail. In this example it is assumed that each of the secondary parts of the heat exchangers are in series and in an order different from the order of the compressor stages 1.1, 1.2, 1.3. It is also assumed that the order is the following: the first heat exchanger 2.1, the third heat exchanger 2.3 and the second heat exchanger 2.2. Hence, the coolant which is taken from a coolant source 8 is flowing to a coolant input 2.1*c* of the secondary part of the first heat exchanger 2.1. Some heat is recovered in the first heat exchanger 2.1 from the gas to the coolant, wherein the temperature of the coolant rises during flowing through the first heat exchanger 2.1. The heated coolant is then directed from the coolant output 2.1*d* of the secondary part of the first heat exchanger 2.1 by the coolant circuitry 5 to the coolant input 2.3*c* of the secondary part of the third heat exchanger 2.3. Again, some heat is recovered in the third heat exchanger 2.3 from the gas to the coolant, wherein the temperature of the coolant rises during flowing through the third heat exchanger 2.3. The heated coolant is then directed from the coolant output 2.3*d* of the secondary part of the third heat exchanger 2.3 by the coolant circuitry 5 to the coolant input 2.2*c* of the secondary part of the second heat exchanger 2.2 in which further heat recovery occurs. The heated coolant is then directed from the coolant output 2.3*d* of the secondary part of the second heat exchanger 2.2 by the coolant circuitry 5 to a coolant output of the compressor 1. The heated coolant or a part of it may be utilized in the manufacturing plant 16, for example.

It should be noted that the series connection of the secondary parts of the heat exchangers may be different from the above, such as the third heat exchanger 2.3, the first heat exchanger 2.1 and the second heat exchanger 2.2.

FIGS. 2*a* to 2*i* illustrate some further examples of connections between different heat exchangers 2 of a compressor 1. These figures mainly disclose the circulation paths of the coolant.

Figure 2A:
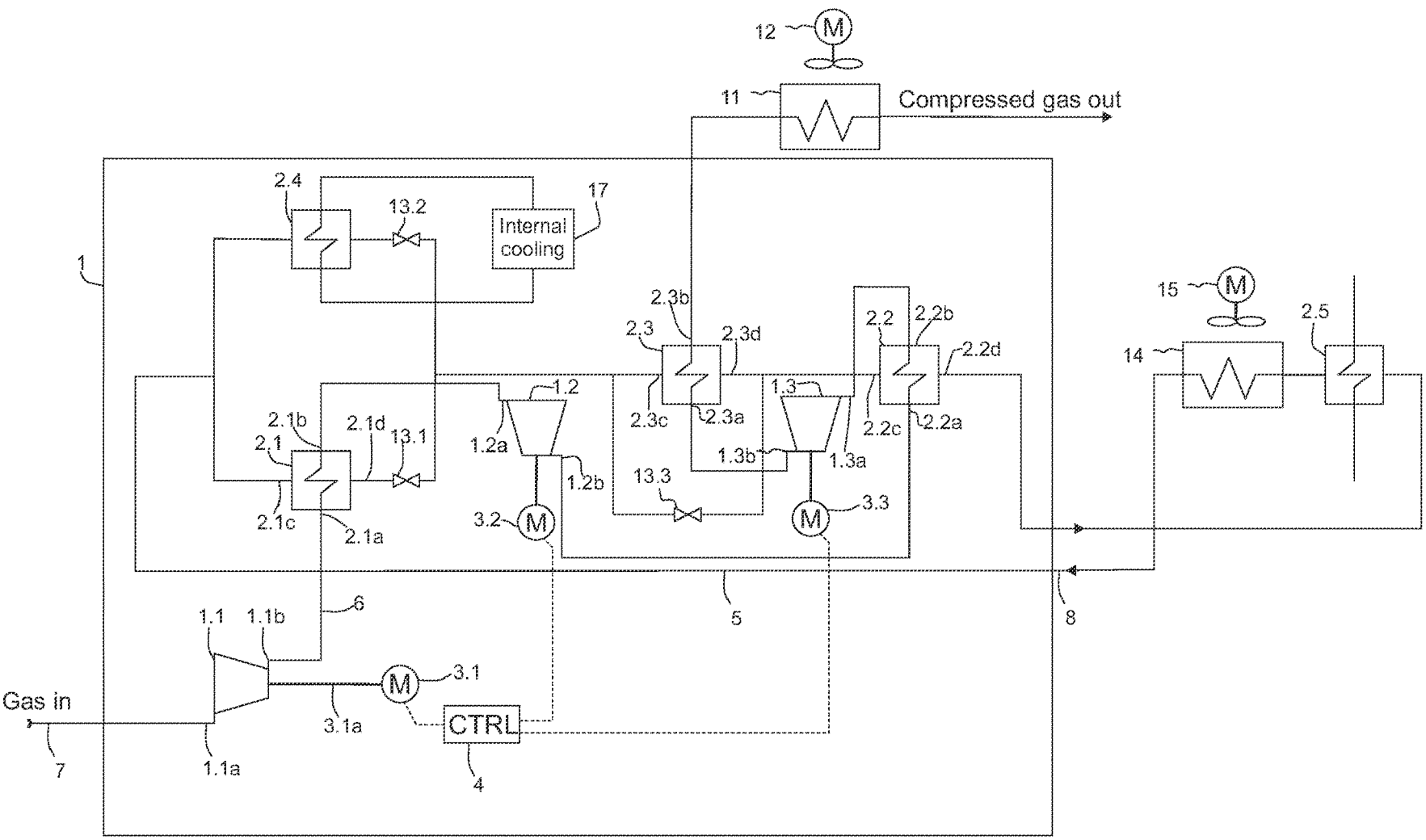
FIGS. 2*a* to 2*i* illustrate some examples of connections between different heat exchangers of a compressor, in accordance with some embodiments.

In the example of FIG. 2*a* there is depicted a system in which a three-stage compressor 1 is utilized to produce compressed air. The order of the coolant circulated in the heat exchangers is the first heat exchanger 2.1, the third heat exchanger 2.3 and the second heat exchanger 2.2. There is also a liquid to liquid heat exchanger 2.4 which cools a coolant to be used in controlling temperature of internal components of control unit 4 and motor(s) 3 of the compressor. In this example, coolant flows of the first heat exchanger 2.1 and the liquid to liquid heat exchanger 2.4 are in parallel and before the coolant enters the second heat exchanger 2.2 and the third heat exchanger 2.3, wherein the temperature of the coolant may be lower than in the second heat exchanger 2.2 and the third heat exchanger 2.3. Thus, cooling efficiency of the control unit and motor(s) may be better than if the liquid to liquid heat exchanger 2.4 were in parallel of the second heat exchanger 2.2 or the third heat exchanger 2.3, or even after the third heat exchanger 2.3.

The internal components of the control unit(s) 4 and the motor(s) 3 of the compressor 1 may include, for example, integrated circuits and other semiconductors as well as other electrical components, etc. It would therefore be advantageous to maintain the temperature of at least the semiconductors well below their maximum operating temperature. This may be achieved by providing the coolant at an early stage of the coolant circuitry to the liquid to liquid heat exchanger 2.4, for example as a first heat exchanger or a second heat exchanger for cooling the internal components.

In accordance with an embodiment the same coolant, which is circulated via the heat exchangers of the compressor stages, also via the heat exchanger of the internal cooling 17. Hence, at least part of heat generated by the internal components is also utilized by the system and is not wasted to the atmosphere.

In this example embodiment there is also a fifth heat exchanger 2.5 for recovering heat from the coolant after the coolant has circulated through the first 2.1, third 2.3 and second heat exchanger 2.2 to lower the temperature of the coolant before recirculating the coolant through the heat exchangers. The coolant may further be cooled by an additional cooler 14 such as a blower, when necessary. The additional cooler 14 may be powered by a motor 15, for example.

The compressed air from the compressor 1 may also be cooled when the temperature of the compressed air should be lower at the utilization location of the compressed air. For this purpose there is another cooler 11, such as a blower and a motor 12 for powering the another cooler 11. In accordance with an example, the additional cooler 11 is a heat exchanger, such as a liquid-liquid heat exchanger.

The compressor 1 may also have a valve 13 or valves to control flow of the coolant and/or the gas. For example, a first valve 13.1 is coupled in the coolant circulation circuitry 8 so that the first valve 13.1 can adjust the flow of coolant through the secondary part of the first heat exchanger 2.1 and a second valve 13.2 can adjust the flow of coolant through the secondary part of the liquid to liquid heat exchanger 2.4. The first valve 13.1 can reduce the flow rate of the coolant through the secondary part of the first heat exchanger 2.1 when less cooling is required, and respectively, the first valve 13.1 can increase the flow rate of the coolant through the secondary part of the first heat exchanger 2.1 when more cooling is required. Similar operation can be performed by the second valve 13.2 with respect to the cooling requirements of the internal circuitry of the compressor 1.

In the example embodiment of FIG. 2*a* there is a third valve 13.3 parallel to the secondary part of the third heat exchanger 2.3. The third valve 13.3 can cause that some or all of the circulating coolant bypasses the third heat exchanger 2.3.

It should be noted that the bypass of the circulant coolant need not be at the last heat exchanger but may be located at some other heat exchanger as well. Furthermore, there may be more than one means for bypassing a heat exchanger so that none, one, or more than one of the means for bypassing may be activated according to the circumstances during operation of the compressor 1.

One purpose for such bypassing is to maintain the temperature of the coolant at the output of the compressor 1 as constant as possible so that the coolant can also be utilized in such arrangements in which the coolant is directed from the compressor 1 to the manufacturing plant 16, in which a constant temperature of the coolant is required or at least recommended. Furthermore, adjusting the way the coolant is bypassed (or not) may affect the temperature of the coolant, wherein if higher temperatures are needed, bypassing may not be used, for example.

Some heat may also be recovered by a fifth heat exchanger 2.5 for recovering heat from the compressor 1 to be utilized in a process of an end user. For example, heat is recovered to a liquid, such as a clean water, which will be used in the process. The coolant circulating in the compressor 1 may be cooled further, when necessary, by an additional cooler 14 comprising, for example, a blower and a motor 15 for powering the another cooler 14.

Figure 2B:
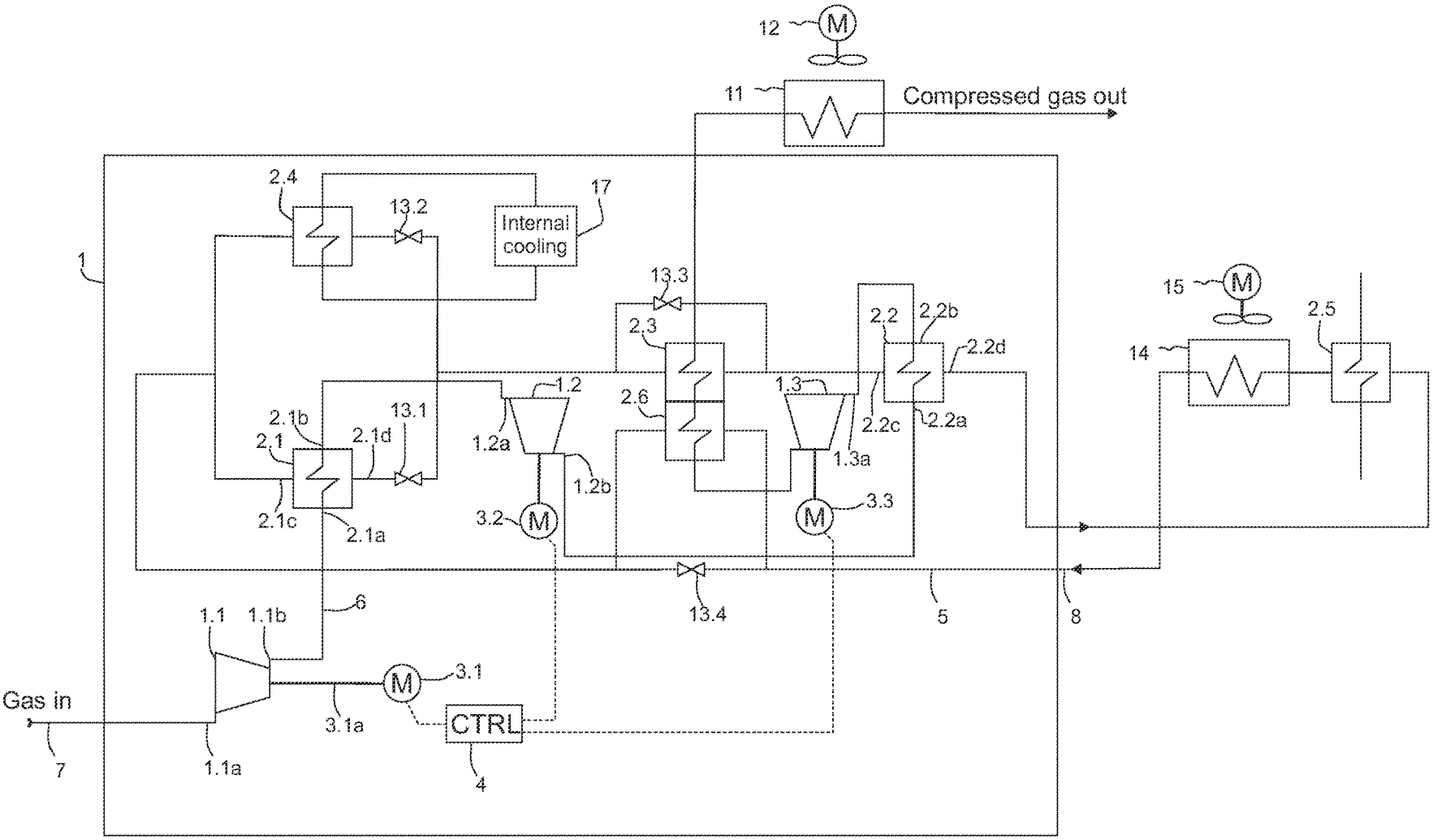

In the example of FIG. 2*b* there is depicted a system which is almost similar to the system of FIG. 2*a* except that there is an additional, sixth heat exchanger 2.6 in the coolant circulation circuitry. The primary part of the sixth heat exchanger 2.6 is coupled with the gas output of the third compressing stage 1.3 in series with the primary part of the second heat exchanger 2.2, wherein compressed gas from the third compressing stage 2.3 can be cooled by two heat exchangers when needed. Flow control of the coolant in the secondary part of the third heat exchanger 2.3 and the sixth heat exchanger 2.6 can be controlled by valves 13.3, 13.4 respectively. Hence, the third valve 13.3 can cause that some or all of the circulating coolant bypasses the third heat exchanger 2.3. Instead of the sixth heat exchanger 2.6 the third heat exchanger 2.3 can have a tertiary part for providing additional heat recovery from the compressed gas after the first compression stage 1.1.

The tertiary part (cooling circuit) can be used, for example, for transferring heat from the compressor components (i.e. not from the compressed air). The tertiary part can be parallel to or in series with any of the compressed air cooling circuits. Furthermore, the tertiary part can be adjustable during operation of the compressor.

Figure 2C:
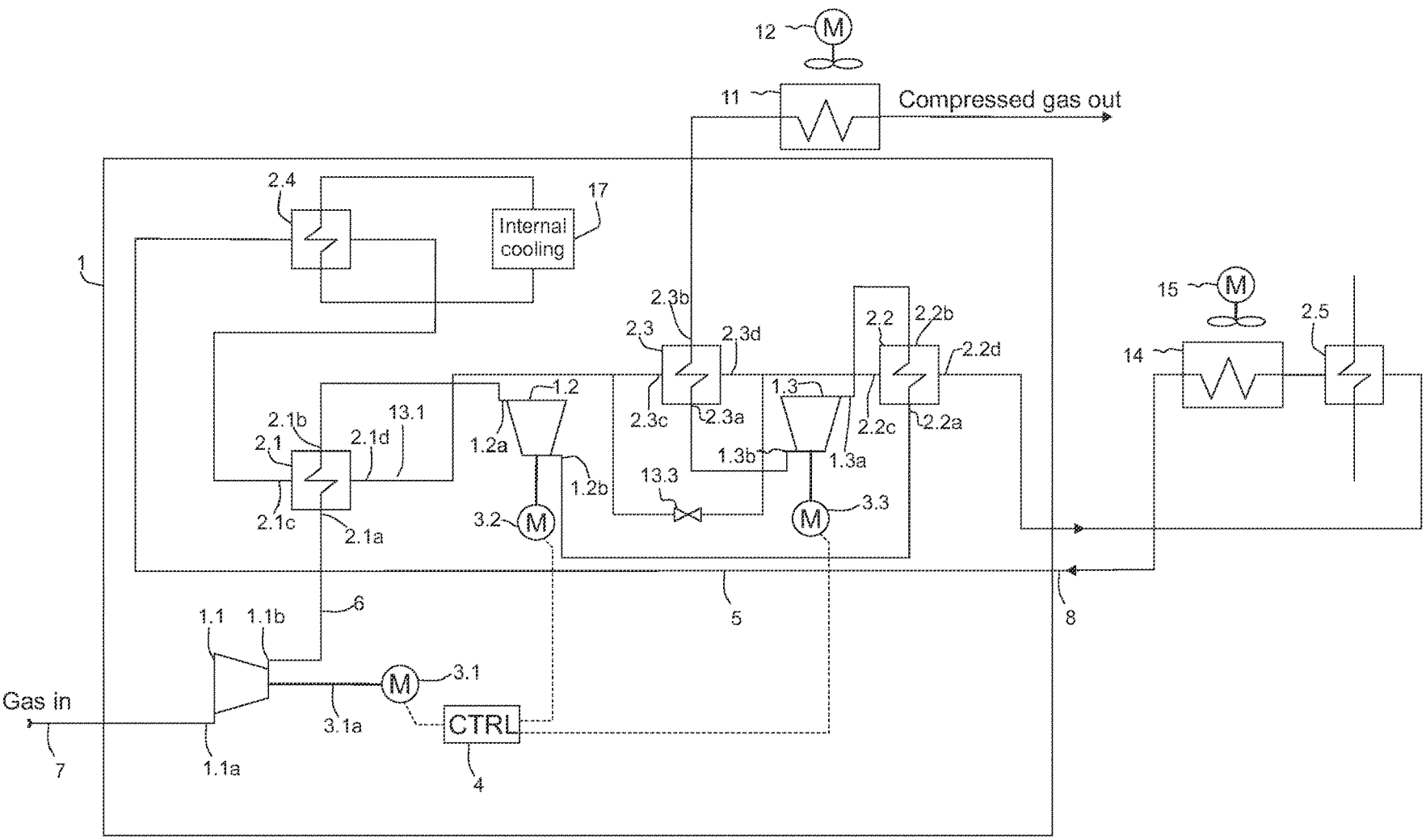

The example of FIG. 2*c* is a modified version of the example of FIG. 2*a*. In this embodiment, the liquid to liquid heat exchanger 2.4, which is for cooling 17 the internal circuitry, is in series with the other heat exchangers 2.1, 2.2, 2.3. Some of the valves depicted in FIG. 2*a* have been left out and only the valve 13.3 parallel to the secondary part of the third heat exchanger 2.3 is maintained to be able to bypass the third heat exchanger 2.3, if conditions (e.g. the temperature of the coolant and/or the compressed gas) allow to do so.

Figure 2D:
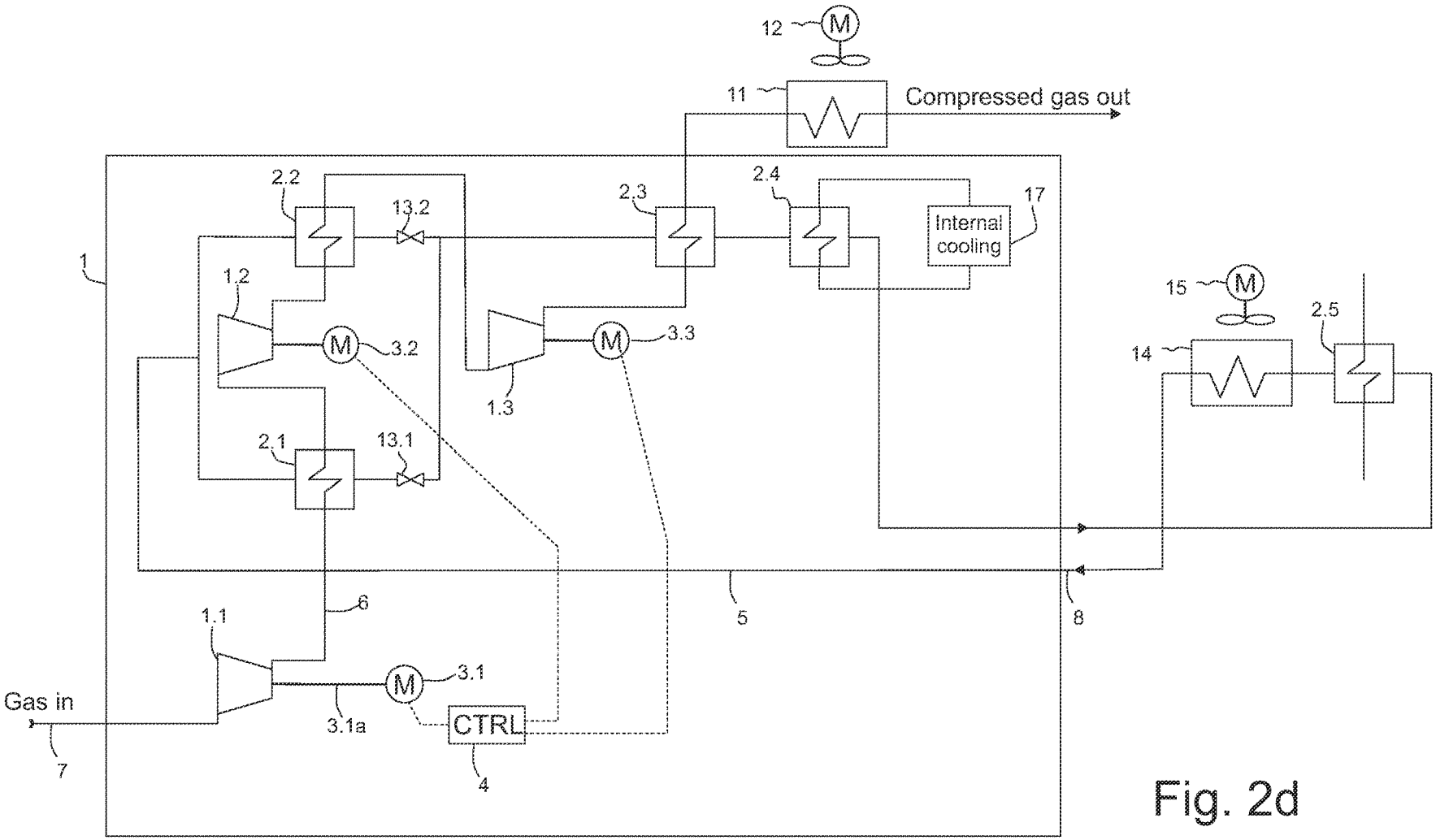

In the example of FIG. 2*d* the first heat exchanger 2.1 and the second heat exchanger 2.2 are in parallel and controlled by valves 13.1, 13.2 whereas the third heat exchanger 2.3 and the liquid to liquid heat exchanger 2.4 are in series with each other and the parallelly coupled first heat exchanger 2.1 and second heat exchanger 2.2.

In accordance with an embodiment some or all of the circulating coolant may be bypassed outside of the compressor 1, e.g. to the atmosphere after one of the heat exchangers 2.1-2.4.

In accordance with an embodiment the order in which the coolant is flowing through the heat exchangers 2.1-2.4 is not fixed but can at least partly be amended according to one or more predetermined criteria. For example, the temperature of gas outputted by the compressing stages 1.1-1.3 can be measured and based on this the order may be changed, if necessary. Another criteria may be the efficiency of one or more compressing stages 1.1-1.3 and if the efficiency of a compression stage 1.1-1.3 should be amended, the order of the heat exchangers 2.1-2.4 can be changed to better correspond with the amended efficiency. A yet another criteria may be the temperature of the coolant wherein that compression stage from which the temperature of the gas is higher than other compression stages may cause that the heat exchanger at the output of that particular compression stage is selected to be at the beginning of the coolant circulation, for example the first in the chain of heat exchangers 2.1-2.4.

Figure 2E:
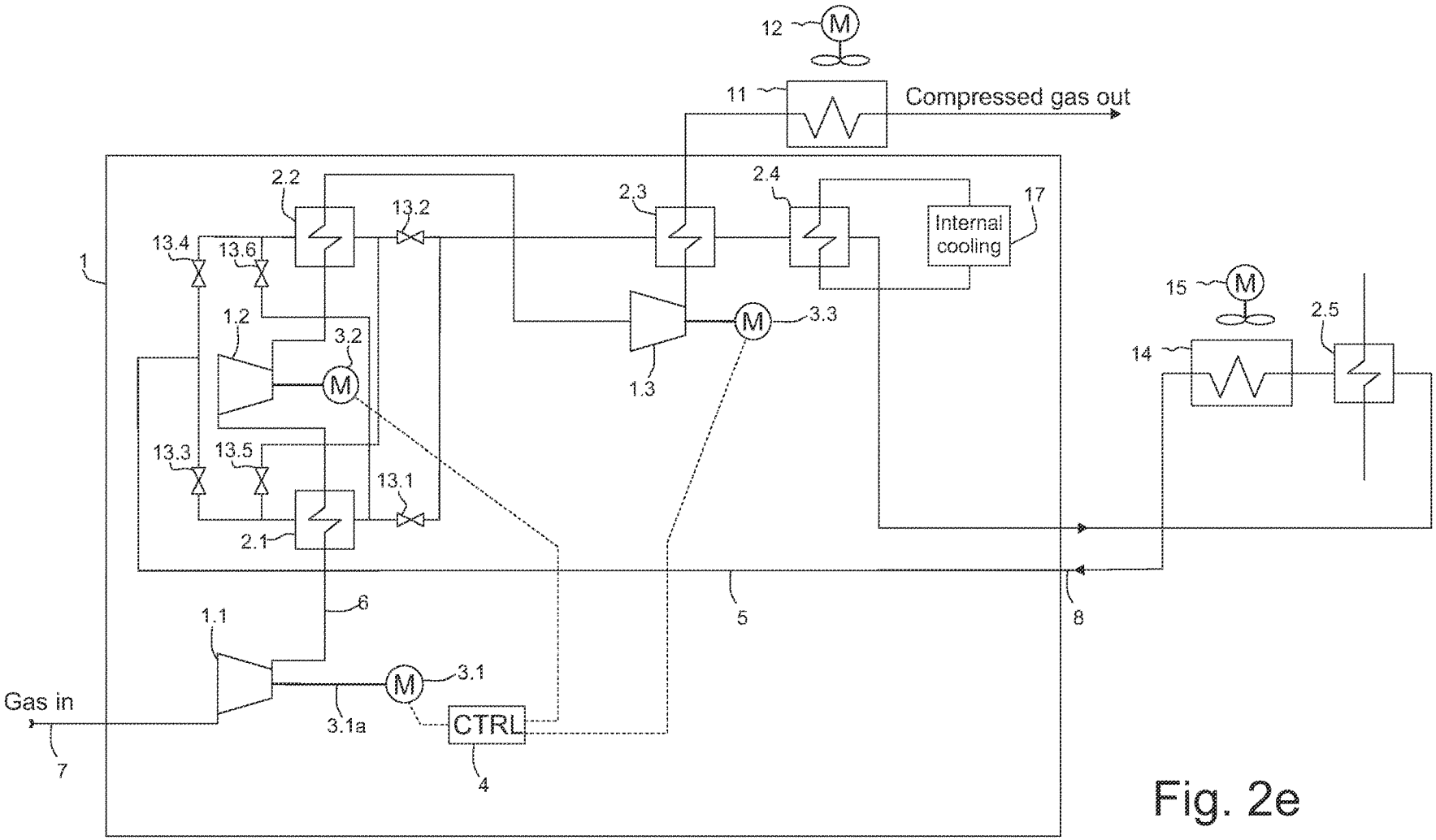

In the example of FIG. 2*e* the flow of the coolant via the first heat exchanger 2.1 and the second heat exchanger 2.2 can be amended with opening/closing valves 13.1-13.6. For example, when the first valve 13.1, the second valve 13.2, the third valve 13.3 and the fourth valve 13.4 are open and the fifth valve 13.5 and the sixth valve 13.6 are closed, the first heat exchanger 2.1 and the second heat exchanger 2.2 are in parallel. When the first valve 13.1, the fourth valve 13.4 and the fifth valve 13.5 are open and the second valve 13.2, the third valve 13.3 and the sixth valve 13.6 are closed, the coolant flows first through the first heat exchanger 2.1 and then through the second heat exchanger 2.2. When the first valve 13.1, the fourth valve 13.4 and the fifth valve 13.5 are closed and the second valve 13.2, the third valve 13.3 and the sixth valve 13.6 are open, the coolant flows first through the second heat exchanger 2.2 and then through the first heat exchanger 2.1.

Figure 2F:
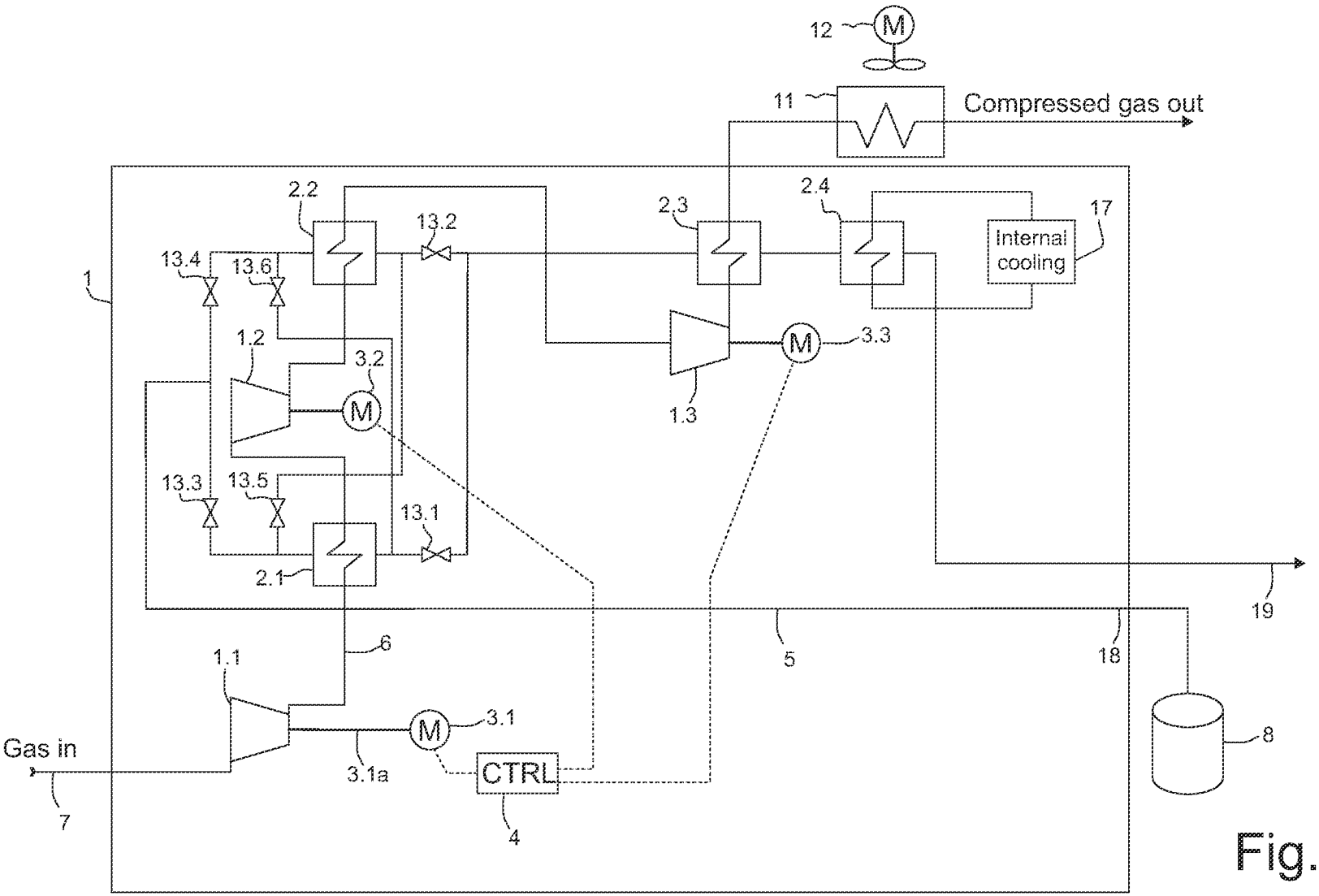

In accordance with an embodiment the coolant is not circulated but the coolant is input from a source 8 and after the last heat exchanger in the flowing path of the coolant the coolant is provided to be utilized by an entity. An example of such arrangement is illustrated in FIG. 2*f*, which is almost similar to the example of FIG. 2*e* but the coolant circuitry is open such that coolant is received from a coolant source 8 via a coolant input 18 to the coolant circuitry 5 and after flowing through the coolant circuitry 5, coolant exits from the coolant circuitry 5 via a coolant output 19. In this example embodiment there is no additional cooler 14 for cooling the coolant after it exits the coolant circuitry nor the fifth heat exchanger 2.5, but some other embodiments may utilize the additional cooler 14 and/or the fifth heat exchanger 2.5.

Figure 2G:
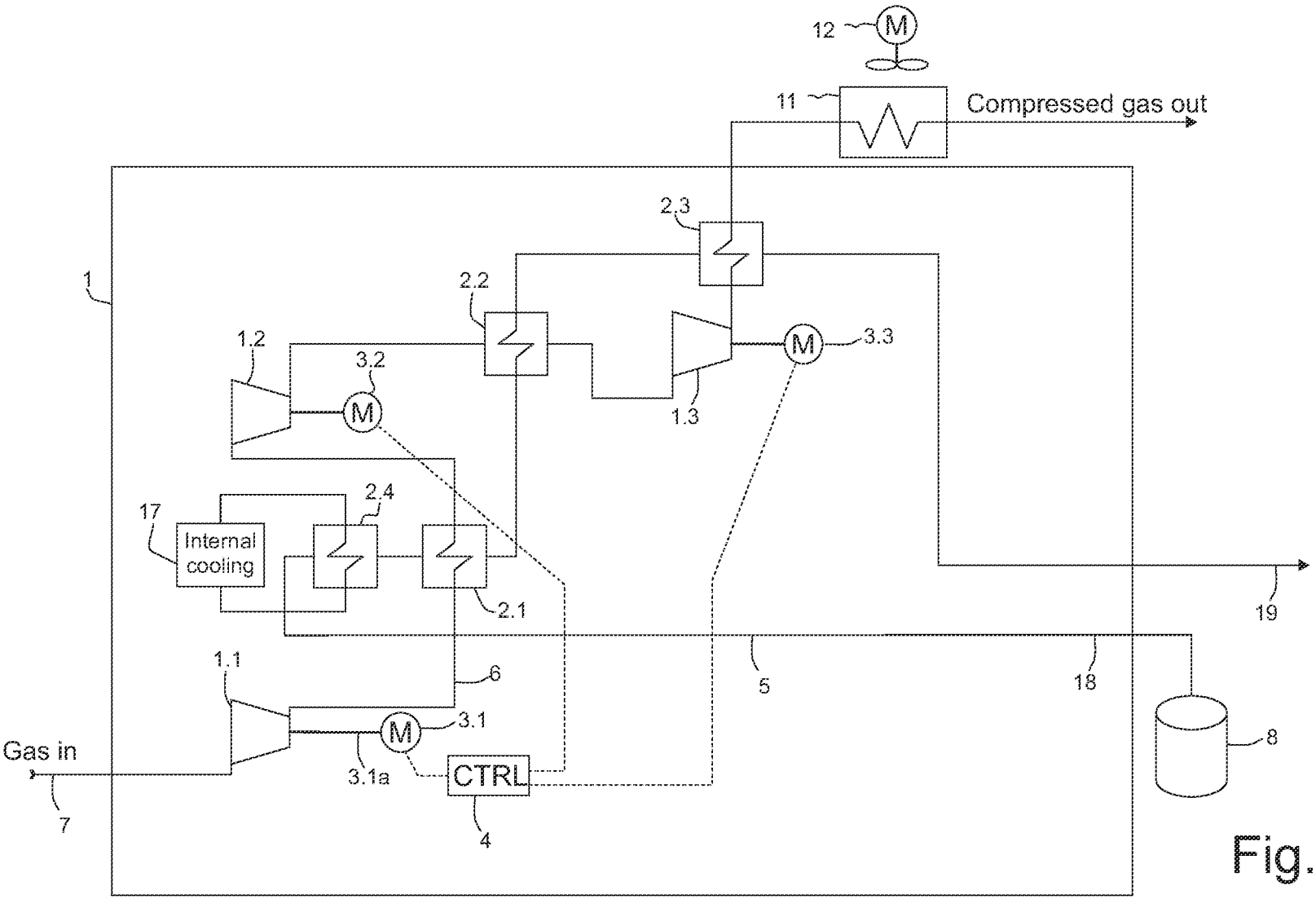

In the example of FIG. 2*g* the first heat exchanger in the coolant circuitry is the liquid to liquid heat exchanger 2.4 used for internal cooling 17 i.e. for cooling the internal components 17, wherein temperature of the coolant is not yet risen by the compressor stages. The coolant is then circulated via the first heat exchanger 2.1 for cooling the first compressor stage 1.1, the second heat exchanger 2.2 for cooling the second compressor stage 1.2 and the third heat exchanger 2.3 for cooling the third compressor stage 1.3. Also in this example the coolant circuitry is open such that coolant is received from a coolant source 8 via a coolant input 18 to the coolant circuitry 5 and after flowing through the coolant circuitry 5, coolant exits from the coolant circuitry 5 via a coolant output 19, but the coolant circuitry 5 may also be closed, if the coolant is not used in the other parts of the process of the end user. It should be noted that also in the closed coolant circuitry the temperature of the coolant may be utilised by the process by circulating the coolant through an additional heat exchanger, for example the fifth heat exchanger depicted in FIG. 2*a*.

Figure 2H:
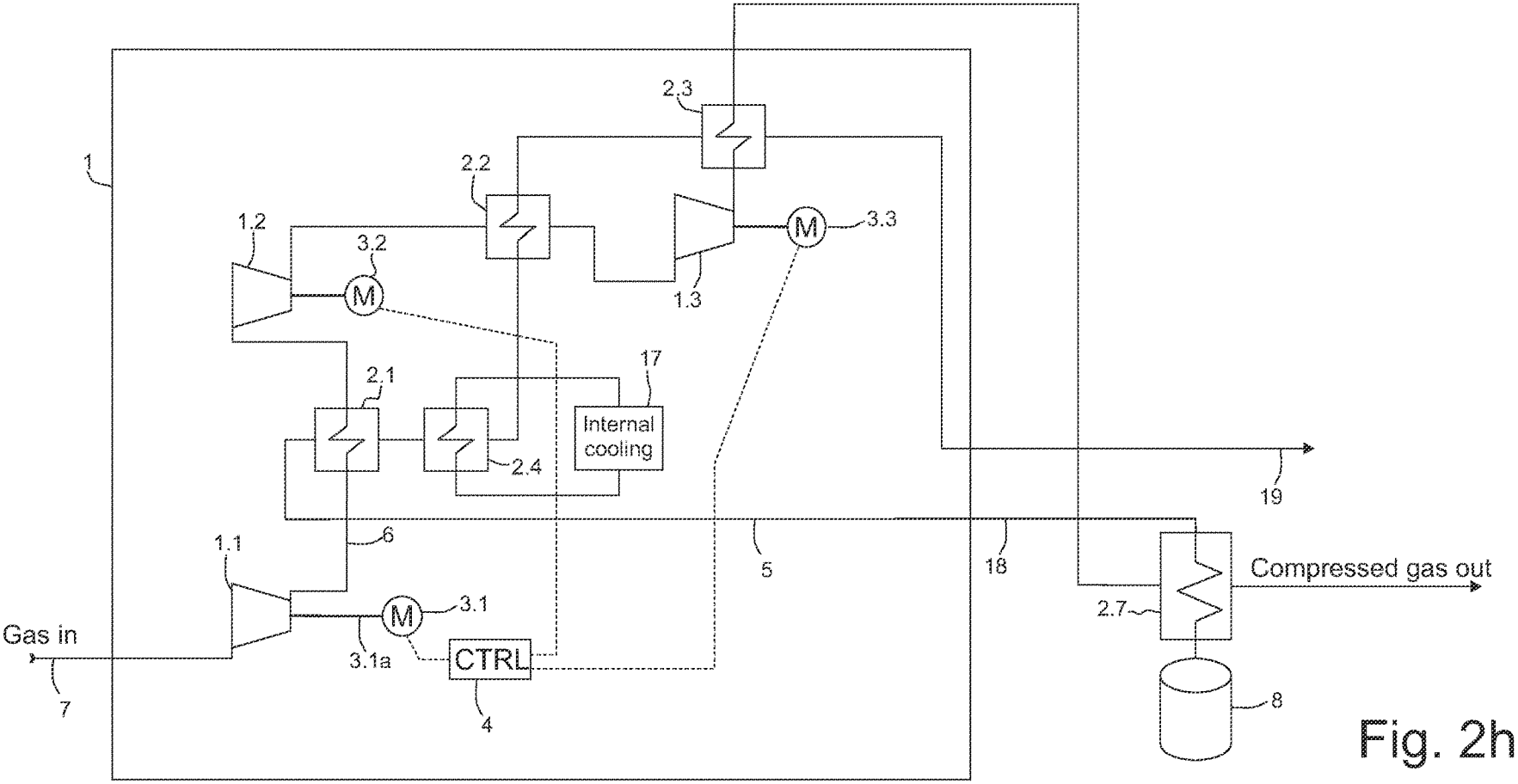

In the example of FIG. 2*h* the second heat exchanger is the liquid to liquid heat exchanger 2.4 used for the internal cooling 17, wherein temperature of the coolant may have slightly risen in the first compressor stage 1.1, which is cooled by the first heat exchanger 2.1. The coolant is then provided to the second heat exchanger 2.2 for cooling the second compressor stage 1.2 and the third heat exchanger 2.3 for cooling the third compressor stage 1.3. Also in this example the coolant circuitry is open such that coolant is received from a coolant source 8 via a seventh heat exchanger 2.7 by which at least some of the heat of the compressed gas is transferred to the coolant so that the temperature of the coolant at the coolant input 18 should not be too low. From the seventh heat exchanger 2.7 the coolant flows to the coolant circuitry 5 and after flowing through the coolant circuitry 5, coolant exits from the coolant circuitry 5 via a coolant output 19, but the coolant circuitry 5 may also be closed, if the coolant is not used in the other parts of the process of the end user.

Figure 2I:
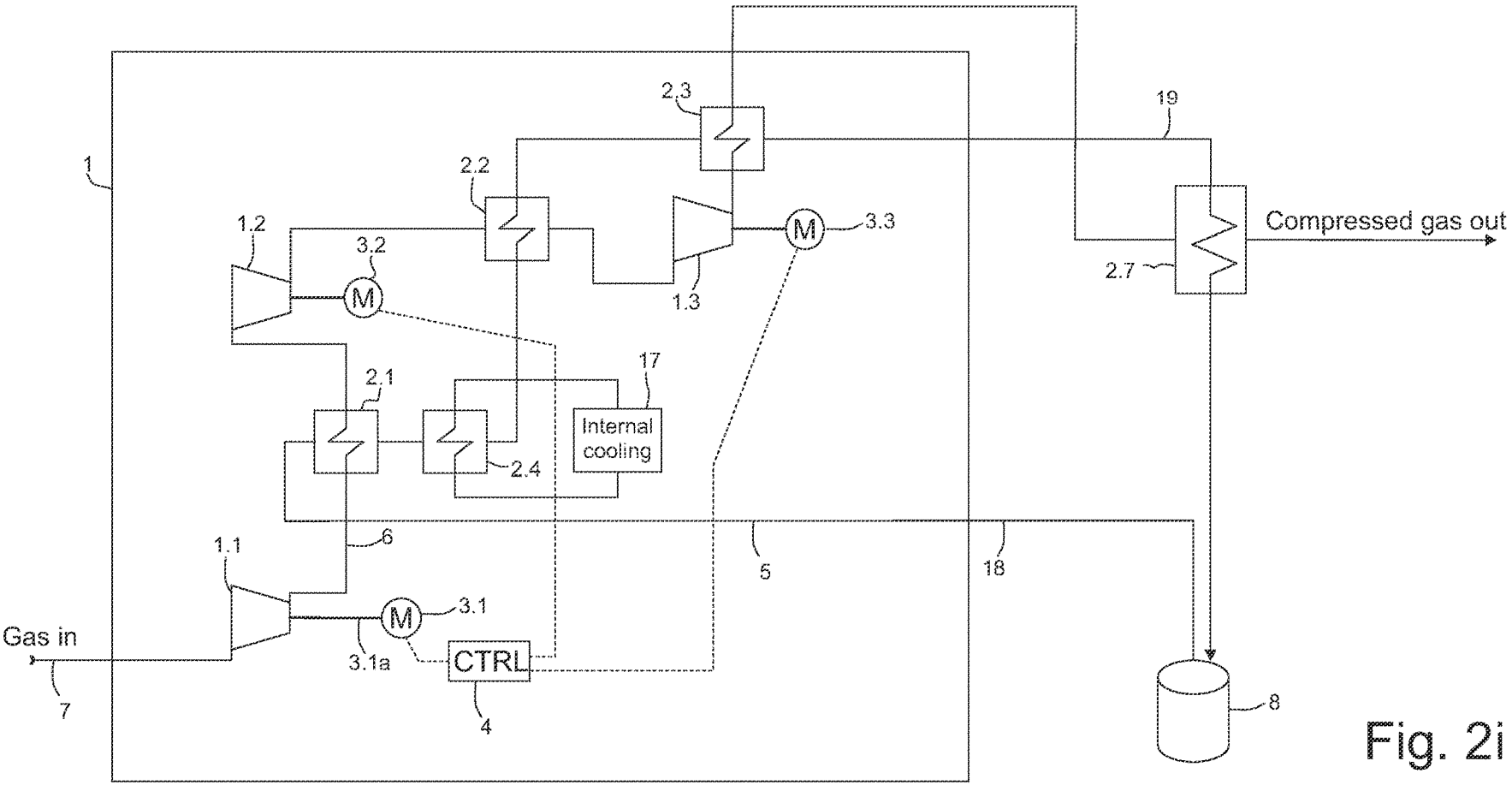

The coolant circuitry of FIG. 2*i* is almost similar to the coolant circuitry of FIG. 2*h* except that the coolant circuitry is closed and that the seventh heat exchanger 2.7 is after the third heat exchanger 2.3 so that at least a part of the heat of the gas at the output of the compressor 1 may be transferred to the coolant before the coolant flows back to the coolant source 8.

It should be noted that the different examples of FIGS. 2*a* to 2*i* could be mixed to further examples. As an example, the arrangement of FIG. 2*i* could be modified so that the coolant from the seventh heat exchanger 2.7 is not flowing back to the coolant source 8 but to further stages of the manufacturing plant 16 for utilization.

It should be noted that also in the embodiments presented in FIGS. 2*g*, 2*h* and 2*i* the order in which the coolant is circulated via the compressor stages may be different from the order in which the gas is compressed by the compressor stages 1.1-1.3. For example, the first heat exchanger 2.1 may be arranged for cooling the third compressor stage 1.3, the second heat exchanger 2.2 may be arranged for cooling the first compressor stage 1.1 and the third heat exchanger 2.3 may be arranged for cooling the second compressor stage 1.2.

In some embodiments the room where the compressor 1 or a plurality of compressors 1 are located may warm up, wherein also the room can be cooled down e.g. by a heat pump or a refrigerator.

The heat exchanger(s) which are between two compression stages can also be called as intercoolers and that heat exchanger or those heat exchangers which are after the last compression stage can also be called as aftercooler(s). By coupling the intercoolers in series before the aftercooler may prevent air from being too hot in the compression process.

In an embodiment in which some or all the coolant can be bypassed after some of the heat exchangers 2.1-2.5 of the coolant circuitry, such as after the last heat exchanger, temperature of the bypassed coolant can be regulated by adjusting the amount of coolant to bypass. For example, the temperature may be kept at a constant value.

According to an embodiment, the bypassed coolant may be used to bring back some energy to the compressor 1, e.g. from an after cooler.

In some situations, warm outside air may be used to warm up the coolant if it is otherwise too cool to be entered to the compressor 1.

In accordance with an embodiment the compressor has two separate cooling circuits so that one of the cooling circuits utilizes the heat recovered by the heat exchangers and another of the cooling circuits dissipates the heat into the atmosphere.

In accordance with an embodiment there is provided an air compressor having an air dryer, which can be, for example, the heat of compression type dryer. The compressor outlet temperature is selected to optimize the efficiency of the dryer and the heat utilization of the manufacturing plant. For example, when demand of heat of the dryer is higher, more heat is recovered to air flowing through the dryer and less heat is recovered to the coolant, and, respectively, when demand of heat of the dryer is smaller, more heat can be recovered to the coolant and less heat is recovered to air flowing through the dryer.

In accordance with some embodiments, the last compression stage is affected least by the temperature, wherein less cooling power may be provided for that compression stage and more cooling power may be provided to other compression stages. In other words, that heat exchanger which is after the last compression stage may receive coolant after all previous heat exchangers in the path of the coolant i.e. is the last heat exchanger downstream of the coolant.

In accordance with an embodiment the coolant flow and the order of the heat exchangers 2 which are partially or completely in series are adjustable based on operating characteristics of the compressor 1 or the environment the compressor 1 is operating.

In accordance with an embodiment the logic with which the order in which the coolant flows through the heat exchangers 2 is adjusted to optimize the coolant temperature and compression efficiency.

In accordance with an embodiment the order in which the coolant flows through the heat exchangers 2 is selected to optimize the coolant temperature and/or energy content of the coolant at the coolant output 19 from the compressor 1.

In the following some factors which may affect the order the coolant flows through the heat exchangers 2.1-2.4 are shortly provided:

- the amount of heat needed for a process utilizing the coolant which exits from the coolant circulation;
- the maximum amount of air which is allowed in the input of the compressor;
- the temperature of the compressed gas at the output of the compressor;
- the temperature of the liquid exiting from the compressor;
- efficiency of the compressor;
- the temperature of the coolant at the input of the circulation path; and/or
- pressure ratios between different compression stages.

It should be noted that there may also be other factors which may be taken into account when determining the path for the coolant within the compressor 1.

To determine the temperature of the coolant, incoming gas, compressed gas etc. some temperature sensors can be installed at appropriate locations in the compressor 1. Accordingly, to determine pressure inside the compressor 1, some pressure sensors can be installed at appropriate locations in the compressor 1 as well. However, these sensors are not depicted in the Figures.

Figure 3:
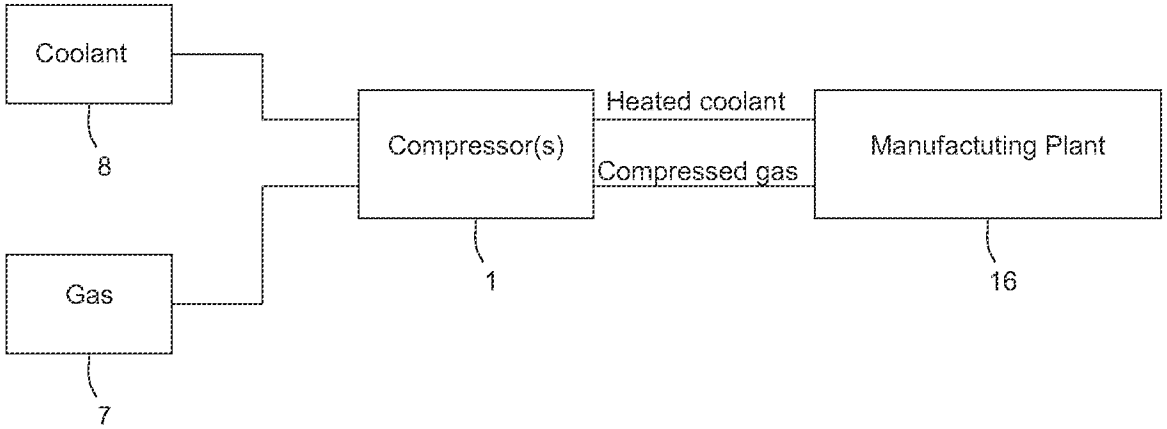
FIG. 3 depicts an example of a process where a multi-stage compressor can be utilized.

FIG. 3 is a greatly simplified diagram of a process where the multi-stage compressor 1 can be utilized. There is the source 7 of the gas and the source 8 of the coolant for the one or more compressors 1, which produce compressed gas and the heated coolant for the manufacturing plant 16.

In the following a method for adaptive heat recovery in the compressor 1 will be described with reference to the diagram of FIG. 2*e*, in accordance with an embodiment. It is assumed that the compressor 1 has three compression stages 1.1-1.3 and three heat exchangers 2.1-2.3 but it is clear that the compressor 1 does not need to have exactly three compression stages 2.1-2.3 but may have only two or more than three compression stages 1.1-1.3 and at least the same amount of heat exchangers 2.1-2.4. It is also assumed that the valves 13.1-13.6 are first in such positions that the coolant flows first via the second heat exchanger 2.2 and then via the first heat exchanger 2.1. Gas to be compressed is flowing from a gas source 7 to a first compression stage 1.1 of the compressor 1. The gas source can be, for example, a gas container or atmosphere. The first compression stage 1.1 compresses the gas wherein the pressure and the temperature of the gas increase. The compressed gas is directed to a primary part of the first heat exchanger 2.1. Coolant is flowing in the secondary part of the first heat exchanger 2.1. In the first heat exchanger 2.1 at least some heat is recovered from the gas to the coolant. From the first heat exchanger 2.1 the gas flows to the second compression stage 1.2 for compression and further to the second heat exchanger 2.2. From the second heat exchanger 2.2 the gas is further compressed in the third compression stage 1.3 after which the compressed gas is cooled by the third heat exchanger 2.3 and output for utilization.

The control circuitry 4 receives measurement signals from one or more temperature sensors and one or more pressure sensors (not shown) and compares the measurement signals with some predetermined criteria to determine whether the coolant flowing path should be changed. If the comparison indicates that one or more of the predetermined criteria is fulfilled, the control circuitry 4 changes states of one or more of the valves 13.1-13.6 so that the coolant flowing path corresponds the measured conditions. For example, the order in which the coolant flows through the first heat exchanger 2.1 and the second heat exchanger 2.2 may be swapped or may be changed to a parallel connection.

In accordance with an embodiment, the temperature of the coolant at the output of the compressor 1 may be much higher than in prior art compressors. As an example, when a cool tap water, the temperature of which is well below 20° C., is used as the coolant, the temperature of the coolant at the output of the compressor 1 may be over 80° C., e.g. 84° C., when the present invention is utilized.

It should be noted here that the flowing path of the coolant need not be closed so that the same coolant circulates in the coolant circuitry 5 of the compressor 1 but may also be open so that the coolant is entered to the coolant circuitry 5 from an external source (e.g. tap water), flows through the coolant circuitry 5 and exits from the coolant circuitry 5.

The invention claimed is:

1. A compressor comprising:

a plurality of compression stages connected in series for compressing gas;

two or more compressed gas heat exchangers for cooling compressed gas, each of the two or more compressed gas heat exchangers comprising at least:

a primary part for transferring the compressed gas through the compressed gas heat exchanger; and one or more secondary parts for transferring coolant through the compressed gas heat exchanger for recovering heat from the compressed gas;

one or more liquid to liquid heat exchangers for cooling of internal components of the compressor comprising at least:

a primary part for transferring coolant through the liquid to liquid heat exchanger; and one or more secondary parts for transferring coolant through the liquid to liquid heat exchanger for transferring heat from the internal components to the coolant;

a coolant circuitry for conducting flow of the coolant via the liquid to liquid heat exchanger and the two or more compressed gas heat exchangers;

a gas flow circuitry for conducting flow of gas via the plurality of compression stages and the two or more compressed gas heat exchangers;

wherein at least two of the two or more compressed gas heat exchangers are in series connection, wherein the compressor comprises valves to control the flow of the coolant so that the liquid to liquid heat exchanger is switched between flowing in parallel with at least one of the two or more compressed gas heat exchangers and flowing to bypass at least one compressed gas heat exchanger of the two or more compressed gas heat exchangers so that the liquid to liquid heat exchanger is in series with the two or more compressed gas heat exchangers.

2. The compressor according to claim 1, wherein the coolant circuitry is at least partly coupled in series so that the liquid to liquid heat exchanger is the first or the second in a sequence of the series connection.

3. The compressor according to claim 2, wherein at least one compressed gas heat exchanger of the two or more compressed gas heat exchangers is coupled with a gas output of each compression stage.

4. The compressor according to claim 2, comprising means for adjusting mutual connections configured to adjust the mutual connections or at least partially bypass any of the compressed gas heat exchangers to optimize coolant temperature and compression efficiency.

5. The compressor according to claim 1, wherein the order in which the secondary parts of the heat exchangers are coupled by the coolant circuitry is selected based on one or more predetermined criteria.

6. The compressor according to claim 5, wherein the one or more predetermined criteria is one or more of the following:

an amount of heat needed for a process utilizing the coolant which exits from a coolant circulation;

a maximum amount of air which is allowed in an input of the compressor;

a temperature of the compressed gas at an output of the compressor;

a temperature of the liquid exiting from the compressor;

an efficiency of the compressor;

a temperature of the coolant at an input of the coolant circuitry; and/or pressure ratios between different compression stages of the plurality of compression stages.

7. The compressor according to claim 6, wherein at least one compressed gas heat exchanger of the two or more compressed gas heat exchangers is coupled with a gas output of each compression stage of the plurality of compression stages.

8. The compressor according to claim 1, wherein the amount of gas heat exchangers of the two or more compressed gas heat exchangers is at least one more than the amount of the plurality of compression stages.

9. The compressor according to claim 8, wherein the means for adjusting mutual connections are configured to adjust the mutual connections or at least partially bypass any of the gas heat exchangers to optimize coolant temperature and compression efficiency.

10. The compressor according to claim 1, wherein the compressor comprises means for adjusting mutual connections between the gas heat exchangers by the coolant circuitry.

11. The compressor according to claim 10, wherein the means for adjusting mutual connections are configured to adjust the mutual connections between the at least one compressed gas heat exchangers of the two or more compressed gas heat exchangers based on operating characteristics of the compressor or the environment the compressor is operating.

12. The compressor according to claim 1, wherein the gas heat exchangers of the two or more compressed gas heat exchangers:

the primary part having a gas input for entering the compressed gas for cooling and a gas output for outputting the cooled gas from the primary part; and the secondary part having a coolant input for entering the coolant and a coolant output for outputting the coolant from the secondary part.

13. The compressor according to claim 1 comprising an additional aftercooler, which is water cooled.

14. The compressor according to claim 13, comprising means for adjusting mutual connections configured to adjust the mutual connections or at least partially bypass any of the compressed gas heat exchangers to optimize coolant temperature and compression efficiency.

15. The compressor according to claim 1 comprising means for adjusting mutual connections configured to adjust the mutual connections or at least partially bypass any of the compressed gas heat exchangers to optimize coolant temperature and compression efficiency.

* * * * *